United States Patent [19]

Roorda et al.

[11] Patent Number: 4,597,797

[45] Date of Patent: Jul. 1, 1986

[54] COMPOSITION OF MATTER USEFUL FOR AGGLOMERATING A METAL-CONTAINING ORE MATERIAL

[75] Inventors: Herm J. Roorda, Rijswijk; Max J. Jipping, Driebergen, both of Netherlands

[73] Assignee: Akzo nv, Arnhem, Netherlands

[21] Appl. No.: 408,675

[22] Filed: Aug. 16, 1982

Related U.S. Application Data

[60] Continuation of Ser. No. 260,213, May 4, 1981, abandoned, which is a division of Ser. No. 741,981, Nov. 15, 1976, Pat. No. 4,288,245.

[30] Foreign Application Priority Data

Nov. 20, 1975 [NL] Netherlands ..... 7513554

[51] Int. Cl.[4] ..... C08K 3/10; C08K 3/26; C08K 5/09; C08L 1/28

[52] U.S. Cl. ..... 106/194; 106/197.2

[58] Field of Search ..... 106/194, 197 C, 197.2

[56] References Cited

U.S. PATENT DOCUMENTS 2,807,591 9/1957 Henry ..... 106/194

4,339,279 7/1982 Hesselgren ..... 106/194

FOREIGN PATENT DOCUMENTS 1448318 9/1976 United Kingdom ..... 106/194

*Primary Examiner*—Allan M. Lieberman

*Attorney, Agent, or Firm*—Stevens, Davis, Miller & Mosher

[57] ABSTRACT

A composition of matter is disclosed which is useful for agglomerating a metal-containing ore material in the presence of water and an alkali metal salt of carboxymethyl cellulose as a binder, the composition comprising an alkali metal salt of carboxymethyl cellulose and one or more salts derived from an alkali metal and a weak acid having a pK value higher than 3 and a molecular weight lower than 500 in an amount of at least 2%, calculated on the weight of the alkali metal salt of carboxymethyl cellulose. The alkali metal salts of weak acids are preferably those derived from acetic acid, benzoic acid, lactic acid, propionic acid, tartaric acid, succinic acid, citric acid, nitrous acid, boric acid and carbonic acid.

8 Claims, No Drawings

COMPOSITION OF MATTER USEFUL FOR AGGLOMERATING A METAL-CONTAINING ORE MATERIAL

This is a continuation of our copending application Ser. No. 260,213 filed May 4, 1981, now abandoned, which in turn is a division of application Ser. No. 741,981, filed Nov. 15, 1976, and now U.S. Pat. No. 4,288,245.

This invention relates generally to a process for agglomerating or pelletizing particles of a metallic ore, preferably an iron-containing ore, in water with an alkali metal salt of a carboxymethyl cellulose as a binder. The invention also relates to the resulting agglomerated particles or pellets.

The agglomeration of metal containing ore material is a well-known technique applied in the ore-treating industry. In the agglomeration process a finely divided granular starting material is converted into particles of larger dimensions. In agglomeration treatments such as briquetting and pelletizing, binders are added as a rule in order that the mechanical properties of the resulting agglomerate may satisfy the strength demands made on it during transportation and handling. The Netherlands Patent Application No. 6 710 530 describes a pelletizing process in which an alkali metal salt of carboxymethyl cellulose is used as a binder. Sodium carbonate is also disclosed in the application as a binder. The mechanical properties of the agglomerates produced by this prior art process have not been entirely suitable for all purposes.

It is therefore an object of this invention to provide a process for agglomerating particles of a metallic ore with a binder containing an alkali metal salt of carboxymethyl cellulose which provides agglomerates having improved mechanical properties.

The invention provides an agglomeration process of the type indicated above wherein an alkali metal salt of carboxymethyl cellulose is used in an amount of at least 0.01%, calculated on the weight of the dry ore material, in combination with one or more salts derived from an alkali metal and a low-molecular weight weak acid having a pK value higher than 3 and a molecular weight lower than 500 in an amount of at least 2%, calculated on the weight of the alkali metal salt of carboxymethyl cellulose. It has been found that the combination of the alkali metal salt of carboxymethyl cellulose in combination with the above-mentioned other salts results in an unexpected improvement in the mechanical properties of the agglomerates formed. This improvement cannot be derived from the effects of each of the two components used separately. As a result of a synergistic effect, the favorable effect in itself of the alkali metal salt of carboxymethyl cellulose on the mechanical properties of the agglomerates formed is unexpectedly and surprisingly improved to a great extent.

The salts which according to the invention are used in combination with the alkali metal salts of carboxymethyl cellulose are derived from weak inorganic or organic acids whose degrees of acidity are such that their pK is higher than 3. The pK is defined here as $pK = -\log K$. where K is the dissocation constant of the acid at 25° C. (see C. D. Hodgman, Handbook of Chemistry and Physics, 30th Ed. 1947, p. 1425). As examples of such acids, which should have a molecular weight smaller than about 500, the following may be mentioned: acetic acid, benzoic acid, lactic acid, propionic acid, tartaric acid, succinic acid, citric acid, nitrous acid, boric acid, carbonic acid and the like.

In the process according to the invention use is made of salts derived from the above-mentioned acids and alkali metals such as lithium, sodium and potassium. The synergistic effect of these salts on the binding action of alkali metal salts of carboxymethyl cellulose manifests itself if the weight ratio of the respective salts to the alkali metal salt of carboxymethyl cellulose is 0.02; and more particularly 0.05, or higher. The salts may be used alone or mixed with one or more similar salts.

The salts of a weak low-molecular weight acid are preferably salts derived from an alkali metal and citric acid or carbonic acid, such as the carbonates and bicarbonates of potassium and sodium. Particularly favorable results are obtained with the use of sodium carbonate. The sodium carbonate may be employed in anhydrous form or as a water of crystallization-containing modification.

Alkali metal salts of carboxymethyl cellulose, more particularly sodium carboxymethyl cellulose, are generally prepared from alkali cellulose and the respective alkali metal salt of monochloroacetic acid. Sodium carboxymethyl cellulose is marketed in various types. It is usually characterized by such quantities as the degree of substitution, that is, the average number of carboxymethyl ether groups per repeating chain unit of the cellulose molecule, and the average degree of polymerization as determined by the current cadoxen method (see W. Brown, "The Cellulose Solvent Cadoxen", in: Svensk Papperstidning 70-(1967)-15-p-458–461). In principle all types of alkali carboxymethyl cellulose can be used in the process according to the invention. It has been found, however, that the most favorable results are obtained if the degree of substitution is 0.4–1.0 and the average degree of polymerization is 300–1700.

The amounts of alkali metal salt of carboxymethyl cellulose and salts to be combined therewith are dependent on the agglomeration method used, the nature of the ore material to be agglomerated and the desired properties of the agglomerates to be prepared. By agglomeration is also to be understood according to the invention the spray-drying of solid-liquid slurries. Any man skilled in the art can establish in a simple way what amounts he will need in various particular cases to obtain optimum results. It has been found that in pelletization the pellets formed will as a rule have particularly favorable properties if as the binder composition there is used the alkali metal salt of carboxymethyl cellulose in an amount of 0.01–1% by weight, more particularly, 0.03–0.3% by weight, and one or more salts derived from an alkali metal and a low-molecular weight weak acid having a pK value higher than 3 and a molecular weight lower than 500 in an amount of 0.001–10% by weight, all percentages being calculated on the total dry weight of the ore material to be agglomerated. Preferably, the alkali metal salt is sodium carbonate in an amount of 0.01–1% by weight. A preferred embodiment of the invention is an agglomerate, more particularly, a pellet of iron-containing ore material, which is formed by using as a binder sodium carboxymethyl cellulose having a degree of substitution of 0.4–1.0 and an average degree of polymerization of 300–1700 in an amount of 0.03–0.3% by weight in combination with sodium carbonate in an amount of 0.01–1% by weight, all percentages being calculated on the total weight of the dry ore material. If use is made of a salt containing water of crystallization, the above-mentioned amounts, of course, relate to the anhydrous salt.

Addition of the binder composition according to the invention may be carried out in a manner commonly applied in the art. For instance, the binder constituents may be mixed as solid matter with the ore material or while dissolved in water. Further, they may be simultaneously or successively added to the ore material before or during the pelletizing treatment. It has been found that particularly favorable results are obtained if use is made of a previously prepared solids mixture containing the alkali metal salt of carboxymethyl cellulose and one or more of the other salts that may be used according to the invention. It is preferred that such a solids mixture should consist of 25–98%, more particularly 25–95% by weight of the alkali metal salt of carboxymethyl cellulose and 2–75%, more particularly 5–75% by weight of sodium carbonate. Besides alkali metal salts of carboxymethyl cellulose and sodium carbonate such a mixture may, of course, contain other substances, for instance, those that are formed as side-products in the preparation of the alkali carboxymethyl cellulose, such as sodium chloride and sodium glycolate. Although in the process of the invention use may be made of alkali carboxymethyl cellulose derived from any one of the alkali metals, it is preferred to use sodium carboxymethyl cellulose. The binder composition according to the invention may be used in combination with other known binders, such as bentonite. Favorable properties in the wet state may be obtained by combining the binder composition according to the invention with attractively inexpensive bentonite grades which have so far been considered unsuitable.

The process provided by the invention is preferably employed for all sorts of iron-containing ores and ore concentrates, such as magnetite and hematite concentrates, natural ores and pyrite residues. However, the process according to the invention is also suitable for non-ferrous ore materials such as ores or ore concentrates of zinc, lead, tin, nickel and chromium. The present process is suitable for oxidic materials, among others, silicates and quartz, as well as sulphidic materials.

The importance of the present invention first of all resides in the resultant improved mechanical properties of the agglomerates formed, particularly in the strongly improved balance of properties of both the wet and the dry pellets. The quality of an ore pellet is usually characterized by quantities such as drop number, wet compressive strength and dry compressive strength. In addition, the quality of the pellet is determined by its resistance to the action on its surface of condensing steam. A measure of this resistance is the steam condensation time. Of further importance is the resistance of the pellet to abrupt rise in temperature.

It has been found that in the pellets provided by the invention these properties show an unexpectedly remarkable improvement. Particularly the drop number is remarkably improved. Moreover, an increase in dry compressive strength is achieved.

The invention will be further described in the following examples. For the purpose of characterizing the agglomerates formed use is made of the following properties that may be considered to be of practical importance.

DROP NUMBER

The drop number indicates how many times a wet pellet can withstand being dropped from a height of 45 cm. onto a hard smooth surface without breaking or showing any cracks.

WET COMPRESSIVE STRENGTH

The wet compressive strength is the maximum load a wet pellet can withstand. It is determined by loading the pellet to breakage with the aid of a plunger moving at a constant speed of 0.8 mm/second.

STEAM CONDENSATION TIME

The steam condensation time is the number of seconds during which a wet pellet on which steam of 100° C. condenses can withstand a constant load of 190 g.

BEHAVIOR UPON ABRUPT INCREASE IN TEMPERATURE

The wet pellets are placed in a gauze tray and suspended in a hot air stream of a particular temperature. After 5 minutes the percentage of pellets disintegrated as a result of sudden formation of steam inside the pellet is determined. This test is carried out in successive steps in each of which the temperature is 50° C. higher than in the preceding step.

DRY COMPRESSIVE STRENGTH

Wet pellets are dried for 12 hours at 60° C. Subsequently, the dry compressive strength is determined in the same way as the wet compressive strength, except that the plunger speed is 0.1 mm/second.

EXAMPLE 1

8 kg. of an ore having a moisture content of 7.5% are mixed with the solid binder composition. This mixture is pelletized in a drum having a diameter of 100 cm and rotating at a speed of 25 revolutions per minute and whose axis of rotation makes an angle of 60° with the horizontal. The pelletization is carried out as follows.

1. Small amounts of the ore mixture are at regular intervals charged into the rotating drum by hand and sprayed with water so that nuclei are formed. After 5 minutes these nuclei are removed and sieved to +3, −4 mm.

2. Of these nuclei 50 grams are after-rolled in a rotating drum over a period of 5 minutes.

3. Subsequently, the pellets are allowed to grow for 13 minutes by regularly spraying them with water, the ore being continuously charged into the drum by hand. The pellets formed are then removed and sieved to +8, −9 mm.

4. Of the sieved pellets 1000 grams are fed back into the rotating drum. In 7 minutes these pellets are allowed to grow to +12 mm, by alternating adding ore and water. The pellets are then removed and sieved to +12, −13 mm.

5. Of these pellets 200 grams are after-rolled in the rotating drum over a period of 10 minutes.

During pelletization the nuclei, the growing nuclei and the pellets must have a bright, moist appearance. Use is made of demineralized water. The pellets having a diameter of 12–13 mm are tested.

The ore treated is a magnetite concentrate composed as follows: 71.4% Fe; 30.2% FeO; 0.45% $SiO_2$; 0.20% $Al_2O_3$; 0.05% CaO; 0.15% MgO; 0.02% P; 0.02% S; 0.06% $Na_2O$; 0.13% $K_2O$. The ground ore has a Blaine-No. of 1910 $cm^2/g$. The percentage by weight of particles smaller than 0.04 mm is 72.1%. By the above-described method four samples were prepared using as binders: 1A: 0.08% sodium carboxymethyl cellulose+0.03% sodium carbonate (previously intermixed); 1B: 0.08% sodium carboxymethyl cellulose; 1C: 0.03% sodium carbonate; and 1D: no binder.

All percentages in this Example and in the following ones are calculated on the dry weight of the ore material to be pelletized. The sodium carboxymethyl cellulose used in the samples 1A and 1B had a degree of substitution of about 0.85 and a degree of polymerization of about 1300.

The properties of the formed pellets are listed in Table I. In brackets are 95%-confidence intervals, upper and lower limits (which are also given in the Tables 2 and 3).

TABLE 1

| | 1A | 1B (comp) | 1C (comp) | 1D (comp) |
|---|---|---|---|---|
| drop number | 22.1 (20.6–23.7) | 10.1 (9.6–10.7) | 3.2 (2.9–3.6) | 2.7 (2.4–3.0) |
| wet compr. strength (kg) | 1.76 (1.68–1.84) | 1.50 (1.44–1.56) | 1.20 (1.10–1.30) | 1.12 (1.05–1.19) |
| steam condensation time (sec) | 18.7 (18.1–19.3) | 11.4 (10.6–11.2) | 6.7 (5.6–7.9) | 5.7 (4.9–6.6) |
| Dry compr. strength (kg) | 7.14 (6.54–7.74) | 4.2 (3.8–4.5) | 2.05 (1.84–2.26) | 0.90 (0.79–1.01) |

TABLE 2

| | 2A | 2B (comp) | 2C (comp) | 2D (comp) |
|---|---|---|---|---|
| drop number | 5.5 (4.8–6.3) | 3.6 (3.1–4.1) | 3.2 (2.8–3.6) | 2.7 (2.4–3.0) |
| wet compr. strength (kg) | 1.67 (1.54–1.80) | 1.49 (1.40–1.58) | 1.15 (1.03–1.27) | 1.12 (1.05–1.19) |
| steam condensation time (sec) | 14.0 (11.9–16.1) | 7.1 (6.3–8.0) | 8.7 (7.5–10.0) | 5.7 (4.9–6.6) |
| dry compr. strength (kg) | 2.58 (2.20–2.96) | 1.34 (1.22–1.46) | 1.60 (1.36–1.74) | 0.90 (0.79–1.01) |

It can be seen that the sodium carbonate, which, in itself, has hardly any influence on the magnitude of the drop number, very much increases the effect of the sodium carboxymethyl cellulose on the drop number. It also appears that the composition according to the invention leads to an unexpected improvement in the dry compressive strength. The binder composition according to the invention also appears to have a synergistic effect on the steam condensation time.

EXAMPLE 2

In the way indicated by and starting from the substances mentioned in Example 1 three samples were prepared, using as binders: 2A: 0.04% sodium carboxymethyl cellulose+0.015% sodium carbonate; 2B: 0.04% sodium carboxymethyl cellulose; and 2C: 0.015% sodium carbonate. The properties of the formed pellets along with those of the sample 1D prepared without binder are summarized in Table 2.

EXAMPLE 3

In this example the effects of various contents of sodium carbonate ($Na_2CO_3$) on the properties of the pellets prepared according to the invention are illustrated. The pellets were made using the procedure described in Example 1. In all cases 0.08% of sodium carboxymethyl cellulose (NaCMC) was added. For comparison a series of comparative examples (3P through 3S) were prepared which did not contain sodium carboxymethyl cellulose. The results are summarized in Table 3.

TABLE 3

| | NaCMC % | $Na_2CO_3$ % | drop number | steam cond. time (sec) | dry compr. strength (kg) |
|---|---|---|---|---|---|
| 3A | 0.08 | 0.000 | 10.1 (9.6–10.7) | 11.4 (10.6–12.2) | 4.18 (3.85–4.52) |
| 3B | " | 0.006 | 13.0 (12.1–13.8) | 16.9 (15.6–18.2) | 4.53 (4.12–4.94) |
| 3C | " | 0.015 | >25 | 20.9 (19.0–22.8) | 6.86 (6.14–7.58) |
| 3D | " | 0.030 | 22.1 (20.6–23.7) | 18.7 (18.1–19.3) | 7.14 (6.54–7.74) |
| 3P | — | 0.000 | 2.7 (2.4–3.0) | 5.7 (4.9–6.6) | 0.90 (0.79–1.01) |
| 3Q | — | 0.006 | 3.0 (2.7–3.3) | 7.5 (6.4–7.6) | 1.15 (0.99–1.31) |
| 3R | — | 0.015 | 3.2 (2.8–3.6) | 8.8 (7.5–10.0) | 1.55 (1.36–1.74) |
| 3S | — | 0.030 | 3.2 (2.9–3.6) | 6.7 (5.6–7.9) | 2.05 (1.84–2.26) |

The table clearly shows that in the presence of both sodium carboxymethyl cellulose and sodium carbonate an additional effect is obtained on the magnitude of the drop number, the steam condensation time and the dry compressive strength.

EXAMPLE 4

This example illustrates the influence on the behavior of wet iron ore pellets in the case of abrupt increase in temperature of the combined use of sodium carboxymethyl cellulose and sodium carbonate. The pellets were prepared by using the procedure described in Example 1. As binder composition there was employed: 0.04% sodium carboxymethyl cellulose+0.015% sodium carbonate (sample 4A). The samples 4B and 4C are comparative samples and contain 0.04% sodium carboxymethyl cellulose and 0.015% sodium carbonate.

TABLE 4

| | % crushed pellets at (°C.) | | | | |
|---|---|---|---|---|---|
| | 450 | 500 | 550 | 600 | 650 |
| 4A 0.04% NaCMC 0.015% $Na_2CO_3$ | 0 | 0 | 0 | 0 | 40 |
| 4B 0.04% NaCMC (comp.) | 0 | 40 | 70 | 100 | 100 |
| 4C 0.015% $Na_2CO_3$ (comp.) | 0 | 40 | 100 | 100 | 100 |

Table 4 shows that both sodium carboxymethyl cellulose and sodium carbonate, if used separately, yield pellets whose resistance to abrupt rise of temperature is distinctly inferior to that of the pellets according to the invention.

EXAMPLE 5

In a procedure similar to that of Example 1, in which, however, the pelletization was not carried out in a drum but in an aircraft tire,, pellets were prepared from magnetite concentrate. As binder compositions, mixtures of sodium carboxymethyl cellulose and sodium citrate were used. In all cases 0.1% of the mixture was added, calculated on the total weight of the concentrate. The wet and the dry compressive strengths of the pellets obtained are tabulated in Table 5.

TABLE 5

| | % NaCMC | % Na—citrate | Wet compr. strength (kg) | Dry compr. strength (kg) |
|---|---|---|---|---|
| 5A | 0.09 | 0.01 | 1.35 | 3.60 |
| 5B | 0.07 | 0.03 | 1.25 | 3.80 |
| 5C | 0.05 | 0.05 | 1.20 | 3.50 |
| 5D | 0.10 | — | 1.10 | 2.10 |
| 5E | — | 0.10 | 0.90 | 1.20 |

Table 5 shows that the combination of sodium carboxymethyl cellulose and sodium citrate leads to distinctly higher values for the wet and the dry compressive strength than when the two binder components are used separately.

EXAMPLE 6

This example illustrates the effect of potassium carbonate used in combination with sodium carboxymethyl cellulose. In the manner described in Example 1, two pellet samples were prepared, the ore having a Blaine-No. of 1600 $Cm^2/g$. The binders used were: 6A: 0.08% sodium carboxymethyl cellulose+0.03% potassium carbonate; and 6B: (comparative sample) 0.08% NaCMC.

Table 6 gives the properties of the formed pellets.

TABLE 6

| Binder | Drop Number | Steam condens. time (sec) | Dry Compr. strength (kg) |
|---|---|---|---|
| 6A 0.08% NaCMC + 0.03% $K_2CO_3$ | 9.5 | 22.0 | 4.5 |
| 6B 0.08% NaCMC | 3.2 | 14.0 | 3.3 |

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A composition of matter useful for agglomerating a metal-containing ore material in the presence of water and an alkali metal salt of carboxymethyl cellulose as a binder, the composition consisting essentially of an alkali metal salt of carboxymethyl cellulose and one or more salts derived from an alkali metal and a weak acid having a pK value higher than 3 and a molecular weight lower than 500, in an amount of at least 2%, calculated on the weight of the alkali metal salt of carboxymethyl cellulose, said composition being essentially free of polyvalent metal salts as well as acid ingredients which cause carbon dioxide to evolve from sodium carbonate.

2. A composition of matter useful for agglomerating a metal-containing ore material in the presence of water and an alkali metal salt of carboxymethyl cellulose as a binder, the composition consisting essentially of an alkali metal salt of carboxymethyl cellulose and one or more salts derived from an alkali metal and carbonic acid, in an amount of at least 2%, calculated on the weight of the alkali metal salt of carboxymethyl cellulose, said composition being essentially free of polyvalent metal salts as well as acid ingredients which cause carbon dioxide to evolve from sodium carbonate.

3. A composition of matter useful for agglomerating a metal-containing ore material in the presence of water and an alkali metal salt of carboxymethyl cellulose as a binder, the composition consisting essentially of an alkali metal salt of carboxymethyl cellulose and sodium carbonate in a amount of at least 2% calculated on the weight of the alkali metal salt of carboxymethyl cellulose, said composition being essentially free of polyvalent metal salts as well as acid ingredients which cause carbon dioxide to evolve from sodium carbonate.

4. A composition of matter useful for agglomerating a metal-containing ore material in the presence of water and an alkali metal salt of carboxymethyl cellulose as a binder, the composition consisting essentially of an alkali metal salt of carboxymethyl cellulose and sodium carbonate, said composition being essentially free of polyvalent metal salts as well as acid ingredients which cause carbon dioxide to evolve from sodium carbonate, and having been prepared from a previously prepared solids mixture containing 25–95 percent by weight of the alkali metal salt of carboxymethyl cellulose and 5–75 percent by weight of sodium carbonate.

5. The composition of claim 1 wherein the alkali metal salt of carboxymethyl cellulose is combined with one or more salts selected from the group consisting of an alkali metal salt of acetic acid, benzoic acid, lactic acid, propionic acid, tartaric acid, succinic acid, citric acid, nitrous acid, boric acid and carbonic acid.

6. The composition of claim 1 wherein the alkali metal salt of carboxymethyl cellulose has a degree of substitution of 0.4–1.0 and an average degree of polymerization of 300–1700.

7. The composition of claim 1 wherein the alkali metal salt of carboxymethyl cellulose is sodium carboxymethyl cellulose.

8. The composition of claim 1 wherein the alkali metal salt of carboxymethyl cellulose is combined with one or more alkali metal salts of citric acid.

* * * * *